US006100641A

United States Patent [19]

Baranov et al.

[11] Patent Number: 6,100,641

[45] Date of Patent: Aug. 8, 2000

[54] PLASMA DISPLAY PANEL OF ALTERNATING CURRENT WITH A SURFACE DISCHARGE AND A METHOD OF DRIVING OF IT

[75] Inventors: Robert Pavlovich Baranov; Victor Markusovich Gutman; Vladiimir Pavlovich Yevdokimov; Anatoly Borisovich Pokryvailo, all of Ryazan, Russian Federation

[73] Assignee: Orion Electric Co., Ltd., Kyungsangbuk-Do, Rep. of Korea

[21] Appl. No.: 09/194,633

[22] PCT Filed: Dec. 29, 1997

[86] PCT No.: PCT/KR97/00282

§ 371 Date: Jan. 28, 1999

§ 102(e) Date: Jan. 28, 1999

[87] PCT Pub. No.: WO98/44532

PCT Pub. Date: Oct. 8, 1998

[30] Foreign Application Priority Data

Mar. 28, 1997 [RU] Russian Federation ..... 97104935

[51] Int. Cl.[7] ..... G09G 3/10

[52] U.S. Cl. ..... 315/169.4; 345/60; 315/169.1

[58] Field of Search ..... 345/60, 62, 67, 345/63, 66; 315/169.1, 169.2, 169.3, 169.4, 160.4

[56] References Cited

U.S. PATENT DOCUMENTS

| | | | |
|---|---|---|---|
| 3,989,974 | 11/1976 | Tottori | 313/217 |
| 4,554,537 | 11/1985 | Dick | 340/775 |
| 4,914,352 | 4/1990 | Gay et al. | 315/169.4 |
| 5,331,252 | 7/1994 | Kim | 315/169.4 |
| 5,446,344 | 8/1995 | Kanazawa | 315/169.4 |

FOREIGN PATENT DOCUMENTS

| | | |
|---|---|---|
| 549 275 | 6/1993 | European Pat. Off. . |
| 554 172 | 8/1993 | European Pat. Off. . |
| 4298937 | 10/1992 | Japan . |
| 8160909 | 6/1996 | Japan . |
| 2 129 595 | 5/1984 | United Kingdom . |
| 2 266 007 | 10/1993 | United Kingdom . |

OTHER PUBLICATIONS

Patent Abstracts of Japan, vol. 17, No. 121, 1993, JP 4–398937.

Patent Abstracts of Japan, vol. 96, No. 10, 1996, JP 8–160909.

Copy of International Search Report for PCT/KR97/00282.

George W. Dick; "Three–Electrode–Per–Pel AC Plasma Display Panel"; *Proceedings of the Society for Information Display*; 1986; vol. 27, No. 3, pp. 183–187.

T. Nakamura, et al.; "Invited Paper: Drive for 40–in.–Diagonal Full–Color ac Plasma Display"; *SID 95 Digest*; 1995, pp. 807–810.

*Primary Examiner*—Don Wong
*Assistant Examiner*—Tuyet T. Vo
*Attorney, Agent, or Firm*—Merchant and Gould P.C.

[57] ABSTRACT

An alternating current plasma display panel with a surface discharge. The panel comprises in each pixel three parallel electrodes, one of the three parallel electrodes being an address electrode, and drive electrodes being perpendicular to them, the three parallel electrodes, the three parallel electrodes, and the drive electrode being separated by dielectric barrier ribs, geometric parameters of electrodes, discharge gaps and gas filling being determined from conditions needed for execution of a surface discharge by sustaining voltage pulses in a pixel between two extreme parallel electrodes with the address electrode arranged between them. When the discharge gap length is increased in the luminescence area, power does not increase but brightness is improved. The ratio of brightness of new/standard and the ratio of power new/standard becomes 1.1–2.3 times better.

4 Claims, 3 Drawing Sheets

PLASMA DISPLAY PANEL OF ALTERNATING CURRENT WITH A SURFACE DISCHARGE AND A METHOD OF DRIVING OF IT

DESCRIPTION

Technical Field

The invention relates to gas-discharge engineering and, in particular, to gas-discharge engineering that can be used in display systems such as AC PDPs and color TV gas-discharge videomodules.

BACKGROUND OF THE INVENTION

The following known plasma display panels lack a desired technical result when used.

1) There is a known alternating current plasma display panel (AC PDP) with a surface discharge where each pixel is comprised of two parallel electrodes arranged on one glass plate and drive electrodes perpendicular to them arranged on another plate separated by dielectric barrier ribs. See EP 05541724A1.

2) There is a known method of driving an alternating current plasma display panel with a surface discharge consisting of a) address pulses on one of the parallel and drive electrodes of a pixel and b) discharge sustain pulses on the parallel electrodes. Primary discharges are formed in all pixels of the plasma panel before application of address pulses. See EP 0549275A1.

3) There is a known alternating current plasma display panel comprising in each pixel two parallel electrodes arranged on one glass plate and drive electrodes perpendicular to them, the latter being arranged on another plate and separated by dielectric barrier ribs. The adjacent pixels being also separated by dielectric barrier ribs arranged along the parallel electrodes. See T. Nakamura, "Drive for 40 in Diagonal Full-Color AC Plasma Display" SID '95 Digest, pp 807–810.

4) There is a known method of AC plasma display panel driving with a surface discharge consisting of a) address pulses on one of the parallel electrodes and one drive electrode per pixel and b) discharge sustain pulses where primary discharges are formed in the part of plasma display panel pixels prior to address pulses application. See T. Nakamura, "Drive for 40 in Diagonal full color AC Plasma Display" SID 95 DIGEST, pp 807–810.

5) The closest device of the same purpose as the invention as to totality of features is an AC Plasma display panel with a surface discharge comprising in each pixel, three parallel electrodes, one of them being an address one, and perpendicular to them, drive electrodes separated by dielectric barrier ribs. See U.S. Pat. No. 4,914,352.

6) The closest method of the same purpose as the method of the invention as to totality of features is the method of driving of an alternating current plasma display panel with a surface discharge consisting in formation of pulses, primary, address and discharge sustain on the electrodes. See U.S. Pat. No. 4,914,352.

DISCLOSURE OF INVENTION

Reasons for the lack of achievement of the desired technical result when using the known plasma display panels 1), 2), 3), 4), 5), and 6) above is the fact that in these methods there are no conditions for improving effectiveness.

The essence of the invention is as follows.

The invention solves the objectives of improving operating parameters of display systems comprising AC plasma display panels.

When performing the invention, a single technical result can be achieved, namely, the increase in effectiveness which is determined by a ratio of a light flux emitted by a plasma display panel in the direction toward a viewer to power consumption of a plasma display panel.

The technical result is achieved by the fact that there is in the inventive device:

an AC plasma display panel with a surface discharge comprising in each pixel three parallel electrodes with one of them being an address one, and drive electrodes being perpendicular to them and separated by dielectric barrier ribs;

geometric parameters of the electrodes, discharge gaps, and a gas filling fixed from conditions of performance of a surface discharge in a pixel between two extreme parallel electrodes over the address electrode arranged between them; and the parallel electrode width set from the ratio dm/de is 0.5 to 1, where dm=pixel address electrode width, de=pixel extreme parallel electrode width; the distance between adjacent edges of the parallel electrodes set from the radio a/b is 0.5 to 1.5, where a=the distance between 30 edges of the address and one of the extreme parallel electrodes of a pixel, b=the distance between edges of the address and the other extreme parallel electrode of a pixel; and gas filling pressure is set from the conditions of voltage ratio Ufe/Ufm is 1.1 to 1.5 Ufm, where Ufm=the voltage of discharge firing in a discharge gap between the address and any of the pixel extreme parallel electrode, and Ufe=the voltage of discharge firing in a discharge gap between the pixel extreme parallel electrodes.

The condition of surface discharge performance in a pixel between two parallel electrodes over the address electrode arranged between them for geometric parameters of electrodes, discharge gaps and the gas filling, makes it possible to provide an essential improvement in brightness (and respectively—light flux) of the plasma display panel at the expense of a maximum possible increase in length of a discharge gap. With that increase in the discharge sustained voltage occurring at a minor value at the expense of discharge performance on the gently sloping area of the right branch of the curve of the gas discharge firing voltage depending upon the product of the gas filling pressure and the discharge gap value (Paschen's curve), the totality of the factors indicated provides an increase in effectiveness. The existence of an address electrode makes it possible to keep a low level of address pulses when driving a plasma display panel; determination of distances between the adjacent edges of the parallel electrodes from the ratio a/b is 0.5 to 1.5 and determination of the gas filling pressure from the condition of provision of voltage ratio Ufe/Ufm is 1.1 to 1.5 makes it possible to optimize the indicated interconnected values and to increase effectiveness to the maximum keeping a low level of address pulses when driving a plasma display panel.

The technical result of the invention method achieved by the fact that in the known method:

It is a method of driving an AC plasma display panel with a surface discharge comprising in each pixel three parallel electrodes, one of them being an address electrode, and drive electrodes perpendicular to the parallel electrodes separated by dielectric barrier ribs consisting in the formation of pulses of priming, address and discharge sustained on the electrodes;

The sustained discharge pulses are formed only on the pixel extreme parallel electrodes and with that external circuits of address and drive electrodes are set in a high impedance state; and The primary pulse amplitudes on address electrodes and the sustained discharge pulses on the extreme parallel electrodes are determined from the ratio Um/Us is 0.8 to 1.2, where Um=the primary pulse amplitude on an address electrode, Us=the discharge sustained pulse amplitude; and primary pulse amplitudes on an extreme parallel electrode and address pulse amplitudes on an address electrode are determined from the ratio: Ue/Uy is 0.8 to 1.2 where Ue=the primary pulse amplitude on an extreme parallel electrode, Uy=the address pulse amplitude.

Formation of discharge sustain pulses only on the pixel extreme parallel electrodes allows for optimum operation conditions of a pixel with maximum length of a discharge gap and, respectively, maximum effectiveness. Further, since discharge currents fail to pass through electric radio elements which form address pulses, the loss of electric power in electric radio elements is thereby reduced to a minimum.

It also results in an increase in effectiveness; the setting of external circuits of address and drive electrodes in a high-impedance state also reduces power loss to a minimum when capacitance currents pass through electric radio elements that form address pulses; the setting of amplitudes of primary pulses on address and extreme parallel electrodes, discharge sustaining pulses on the extreme parallel electrodes and address pulses on an address electrode from the ratio Um/Us is 0.8 to 1.2 and Ue/Uy is 0.8 to 1.2 makes it possible to optimize parameters of the said pulses when driving a plasma display panel with a maximum increase in effectiveness.

BRIEF DESCRIPTION OF DRAWINGS

The present invention may be better understood with reference to the following description taken in conjunction with the accompanying drawings in which.

BEST MODE FOR CARRYING OUT THE INVENTION

Data confirming the possible embodiment of every one of the objects of the invention group applied with achievement of the above technical result are as follows.

Figure 1:
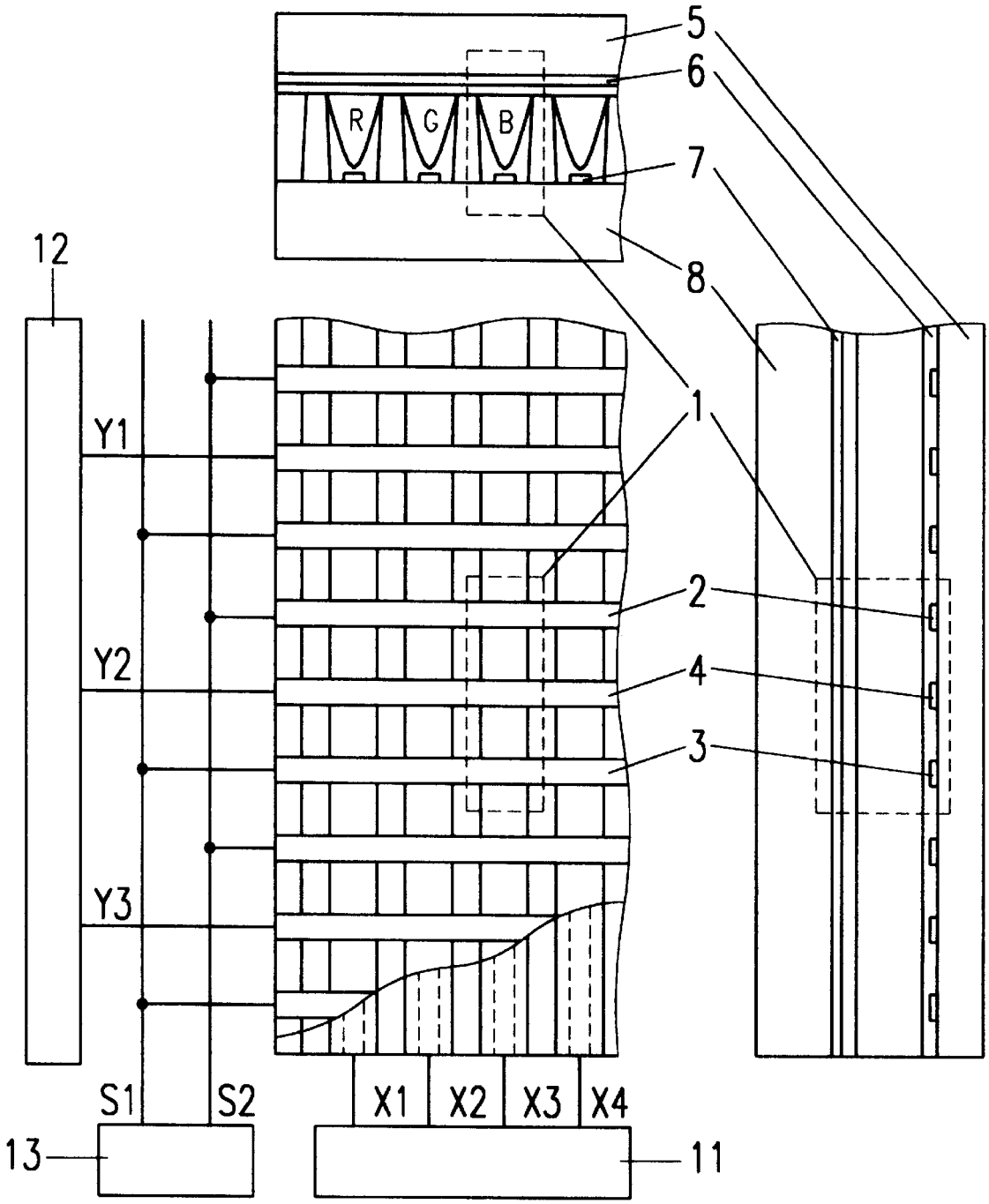
FIG. 1 is a schematic view showing an alternating current plasma display panel with a surface discharge.

As to the object-device, schematically shown in FIG. 1 an alternating current plasma display panel with a surface discharge comprising pixels 1, each of them containing three parallel electrodes—extreme 2 and 3 and address 4, arranged on the upper glass plate 5 while thereunder transparent dielectric coating 6 and drive electrode 7 are arranged on the known glass plate 8 among separating dielectric barrier ribs 9 with a phosphor coating 10 over them, e.g. red R, green G or blue B color of luminescence. The device electrodes have inputs connected to source 11 of address pulses on the coordinated X, the address electrodes having inputs to be connected to source 12 of address pulses on the coordinated Y, and the extreme parallel electrodes of the pixels are formed in two groups S1 and S2 and have inputs to be connected to source 13 of discharge sustain pulses.

Figure 2:
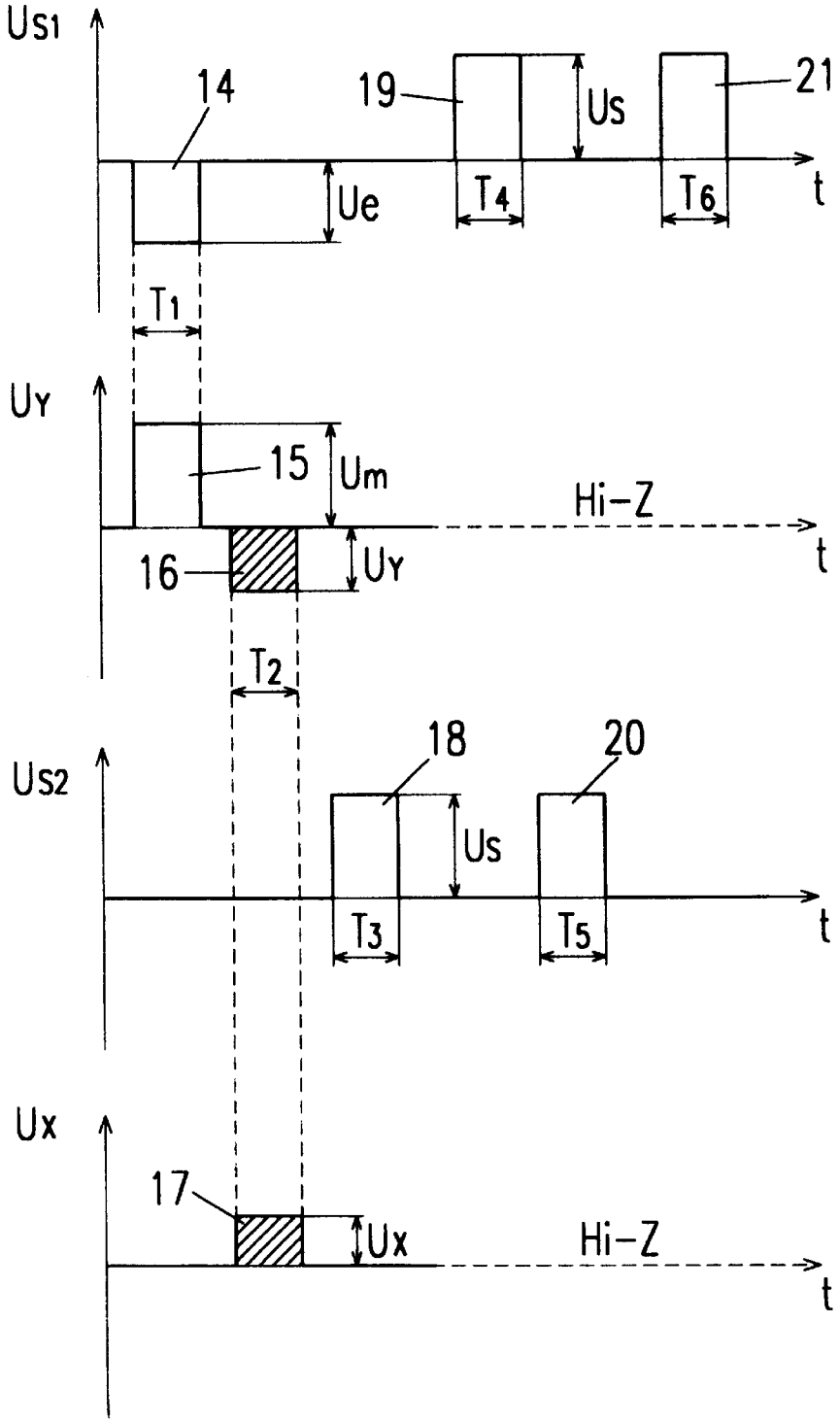
FIG. 2 is a time chart of voltage pulses on the plasma display panel electrodes.
Figure 3:
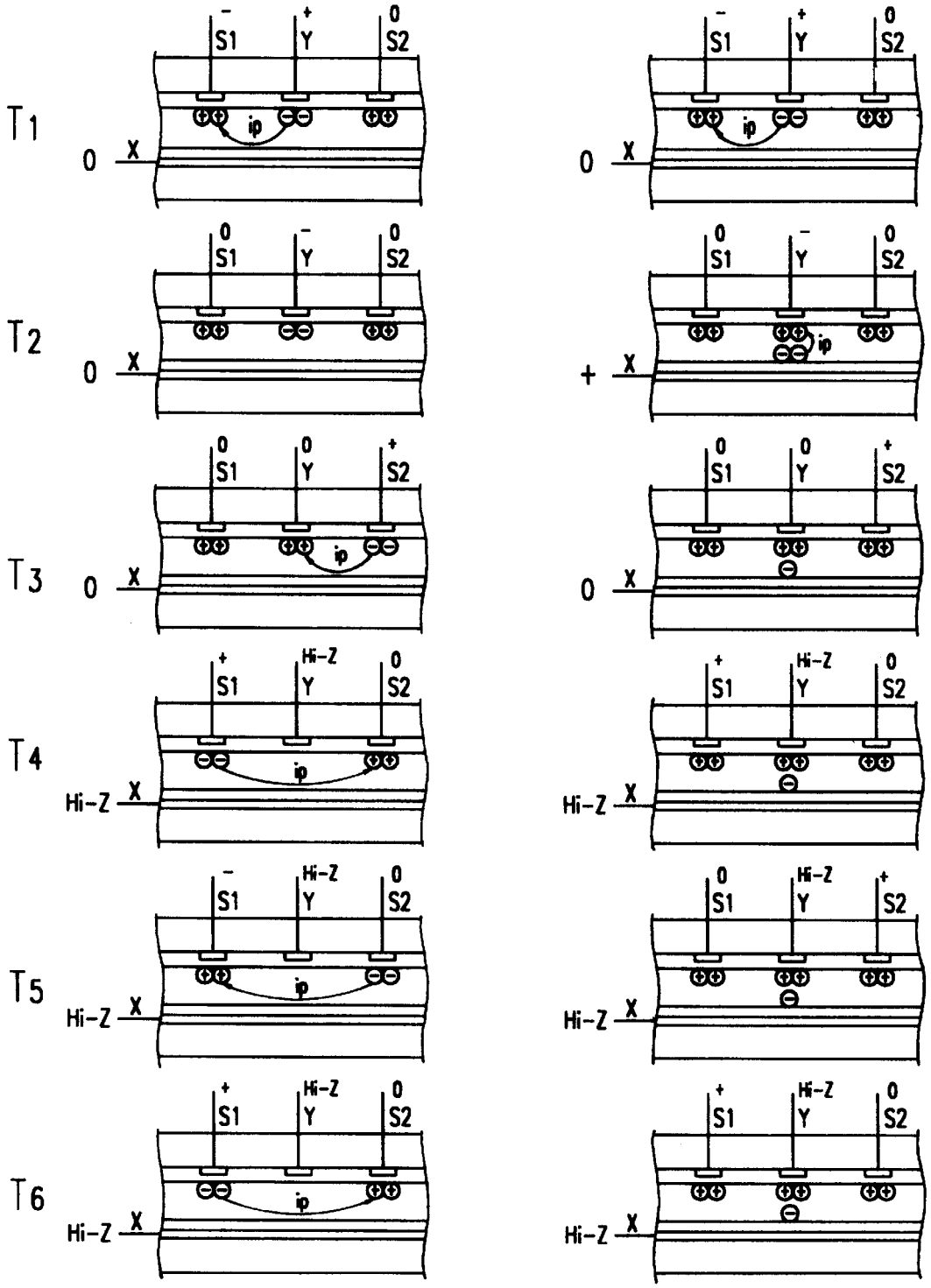
FIG. 3 is a diagram of states of electric charges in a pixel.

On the parallel (including address) electrodes of the plasma display panel are formed voltage pulses illustrated in FIG. 2 and with their effect charges arising in the pixels and accumulation of electric charges taking place on dielectric and phosphor electrode coatings, their time charts of the states being given in FIG. 3.

In the time interval T1, to the pixel extreme parallel electrodes, united in the group S1, pulse 14 is applied, being of negative polarity and having the amplitude Ue, and to the address electrodes of all pixels primary pulse 15 is applied, being of positive polarity and having amplitude Um. As a result of the effect of these pulses' discharges, a discharge gap arises between the indicated electrode, and accumulation of electric charges takes place, as shown in FIG. 3.

In the time interval T2 to the address electrode of the pixel line selected, address pulse 16 is applied, being of negative polarity and having the amplitude Uy. To the drive electrodes of the pixel line selected with the pixels that are not luminescent, address pulse 17 is applied, being of positive polarity and having the amplitude Ux. With that in a discharge gap between an address and drive electrodes of these pixels arises a charge charging the polarity of an electric charge on the dielectric coating of the address electrode. In pixels to be luminescent, no charge of polarity of an electric charge takes place.

In the time interval T3 to the pixel extreme parallel electrodes, united in the group S2, the discharge sustain pulse 18 is applied being of positive polarity and having the amplitude U5 resulting in the appearance of charges in discharge gaps between these electrodes and address electrodes in the pixels to be luminescent. With that, on the dielectric coating of the extreme parallel electrodes, united in the group S2, the polarity of the charges changes. In the pixels not to be luminescent, no change of polarity takes place.

Further, in the time intervals T4, T5, T6 to the extreme parallel electrodes, and in turn, applied discharge sustain pulses 19, 20, 21 having the amplitude Us with that these pulses provide existence of periodical succession of charges in pixels being luminescent with the appropriate change in polarity of electric charges taking place.

A surface discharge is accomplished in a pixel in a discharge gap between extreme parallel electrodes over an address electrode arranged between them, with the address electrode external circuit as well as the extreme circuit of the drive electrode being in a high impedance state. On the finishing of this state of the electrodes, primary pulses are again applied.

EXAMPLE

The effectiveness of the proposed PDP design was checked by way of an experimentation. The experiment was conducted on a color PDP with the pitch of parallel electrodes being 0.3 mm on a separate section of the panel allowing light-technical measurements to be made with a device of the type MINOLTA (CA-100).

To start, measurements were made for standard operating conditions of a pixel, wherein a discharge took place between parallel electrodes at a distance of 3 mm. Then measurements were made for new operating conditions of a pixel with a discharge occurring between extreme parallel electrodes at a distance of 0.6 mm and where there was an address electrode between the parallel electrodes as shown in FIG. 1 of this description.

Measurements were made for two pulse frequencies of the discharge sustaining voltage and the results of the experiment are given in the following table 1:

TABLE 1

| KHz | Condi. | W | cd/M$^2$ | B/P | N/S |
|---|---|---|---|---|---|
| 12.5 | Standard | 1.93 | 43.5 | 0.222 | 2.33 |
| 12.5 | New | 1.8 | 93 | 0.512 | 2.33 |
| 25 | Standard | 3.78 | 100 | 0.275 | 1.72 |
| 25 | New | 3.24 | 154 | 0.475 | 1.72 |

note:
KHz - Discharge sustaining voltage pulse frequency
Condi. - Operating condition
W - power
cd/M$^2$ - Brightness
B/P - Effectiveness,
B - brightness of pixel luminescence in white The table 1 shows that when the discharge gap length is increased in the luminescence area, power does not increase but brightness is improved. The ratio of brightness of new/standard and the ratio of power new/standard become 1.1 to 2.3 times better, thus the above material makes it possible to assess the proposed design more impartially than the known one.

Industrial applicability

Thus, the above data certify industrial applicability of the present invention with the conditions as follows:

the means embodying the invention which is designed to be used in industry, namely, in display systems comprising an AC plasma display panel, in particular in color TV plasma videomodules;

means embodying the invention provide the achievement of the technical results.

What is claimed is:

1. A plasma display panel of alternating current with a surface discharge, comprising in each pixel three parallel electrodes with one of the three parallel electrodes being an address electrode and the other two being extreme parallel electrodes, and a drive electrode being perpendicular to the three parallel electrodes, the three parallel electrodes and the drive electrode being separated by dielectric barrier ribs, geometric parameters of the electrodes and gas filling being determined from conditions needed for execution of a surface discharge by sustaining voltage pulses in a pixel between electrodes such that the width of the parallel electrodes is determined from the ratio dm/de being 0.5 to 1.0, and the distance between adjacent edges of parallel electrodes is determined from the ratio d/b being 0.5 to 1.0, and the pressure of gas filling is determined from the condition necessary for voltage to provide the ratio Ufe/Ufm being 1.1 to 1.5, where, dm=the width of a pixel address electrode de=the width of extreme parallel electrodes, d=the distance between edges of the address electrode and one of the extreme parallel electrodes of the pixel, b=the distance between edges of the address electrode and the other extreme parallel electrode of the pixel, Ufm=voltage of discharge firing in a discharge gap between the address electrode and any of extreme parallel electrodes of the pixel, and Ufe=voltage of discharge firing in a discharge gap between the extreme parallel electrodes of the pixel.

2. The method of driving an alternating current plasma display panel with a surface discharge, comprising in each pixel three parallel electrodes, with a central one of the three parallel electrodes being an address electrode and the other two being extreme parallel electrodes, and a driving electrode being perpendicular to the three parallel electrodes, the three parallel electrodes and the drive electrode being separated by dielectric barrier ribs, comprising the step of forming on the electrodes priming pulses, address pulses, and discharge sustaining pulses, whereas improvement comprises the step of forming the discharge sustaining pulse only on the extreme parallel electrodes and where external circuits of address and drive electrodes are set in a high impedance state during applying the discharge sustaining pulse.

3. The method of driving an alternating current plasma display panel with a surface discharge as claimed in claim 2, wherein the amplitudes of the discharge sustaining pulses on the parallel electrodes are determined from the ratio Um/Us being 0.8 to 1.2 where,

Um=the amplitude of priming pulse on an address electrode,

Us=the amplitude of discharge sustaining pulse.

4. The method of driving an alternating current plasma display panel with a surface discharge as claimed in claim 2, wherein the amplitude of priming pulses on an extreme parallel electrode and of address pulses on an address electrode are determined from the ratio Ue/Uy being 0.8 to 1.2 where,

Ue=the amplitude of priming pulse on an extreme parallel electrode,

Uy=the amplitude of address pulse.

* * * * *